United States Patent [19]

Labelle

[11] Patent Number: 4,664,170

[45] Date of Patent: May 12, 1987

[54] ROLLING FIREDOOR

[75] Inventor: H. M. Robert Labelle, Cornwall, Canada

[73] Assignee: Martinray Industries Ltd., Cornwall, Canada

[21] Appl. No.: 805,552

[22] Filed: Dec. 6, 1985

[51] Int. Cl.[4] ..... E05F 15/20

[52] U.S. Cl. ..... 160/133; 160/8; 160/9

[58] Field of Search ..... 160/23 R, 7, 8, 9

[56] References Cited

U.S. PATENT DOCUMENTS

| | | | |
|---|---|---|---|
| 1,617,439 | 2/1927 | Duncanson | 160/8 |
| 2,038,523 | 4/1936 | Cahill | 160/7 |
| 2,564,208 | 8/1951 | Michelman | 160/9 |
| 3,007,342 | 11/1961 | Wardlaw | 160/9 X |
| 3,685,567 | 8/1972 | Pemberton et al. | 160/8 |
| 4,147,197 | 4/1979 | Bailey et al. | 160/8 X |

*Primary Examiner*—Robert W. Gibson, Jr.

*Attorney, Agent, or Firm*—Charles E. Brown; Charles A. Brown

[57] ABSTRACT

A rolling firedoor having a closure drum on which a closure is wound, and a chaindrive for rotating the drum to raise or lower the closure. The chaindrive is disconnected from the drum during a fire. Means are provided for reconnecting the chaindrive to the drum from the ground so that the door can be raised in an emergency.

9 Claims, 8 Drawing Figures

ROLLING FIREDOOR

BACKGROUND OF THE INVENTION

1. Field of the Invention

This invention is directed toward an improved rolling firedoor.

Rolling firedoors are usually employed in commercial establishments to close large openings and comprise horizontally disposed metal slats hingedly joined together to form a closure. A drum is rotatably mounted in a horizontal position at the top of the opening. One end of the closure is fixed to the drum. Rotation of the drum in either direction winds or unwinds the closure on it, opening or closing the opening. When the closure is wound up to have the opening open, spring means associated with the drum, as are well known, provide enough tension to keep the drum from rotating under the unbalanced weight of the closure. Without the spring means, the closure would unwind and close the opening.

2. Description of the Prior Art

The drum is normally rotated by a chain drive operated from the floor below the drum. In case of a fire, the chain drive can be disconnected, the tension of the spring means reduced, and the closure will unroll off the drum under the influence of gravity to close the opening. A fusible link, melted by the heat of a fire, is used to automatically disconnects the chain drive from the drum, and to reduce the tension of the spring means to allow the closure to close. Braking means, usually in the form of a rocker escapement mechanism, are employed to control the rate of descent of the closure during a fire. These descent-rate control means are also usually made operative on the melting of a fusible link.

Examples of firedoors of the above type are shown in whole or in part in U.S. Pat. Nos. 2,564,208; 2,946,377 and 3,685,567, and in Canadian Pat. No. 1,088,580 by way of example.

A common problem with the known firedoors is that once the fusible link is broken, and the closure is automatically lowered, the closure cannot be raised again until the chain drive is reconnected to the drum. In known doors, this involves having a person climb up to the drum to reconnect the chain drive to the drum. A ladder is needed which can be hard to find in an emergency situation.

SUMMARY OF THE INVENTION

It is the purpose of the present invention to provide a firedoor that can have its chain drive quickly reconnected to the drum, from the ground, after its closure has been automatically lowered by disconnecting the chain drive from the drum on the melting of a fusible link. Thus the closure can be quickly and easily raised in emergency situations if needed.

In accordance with the present invention, the braking means are disengaged and the chain drive means are re-engaged by re-engaging means operable from the ground. Once the re-engaging means have been operated, the chain drive means can be operated to raise the closure.

The invention is particularly directed toward a rolling firedoor having a support drum adapted to be mounted horizontally across the top of an opening, and a closure comprising a series of horizontally extending slats hingedly connected together. The closure is attached at one end to the drum and adapted to be wound up on the drum when the drum is rotated in one direction. Rotating means are provided, operable from the ground, for rotating the drum in either direction to unwind or wind the closure on the drum. Disengaging means are provided for automatically disengaging the drum rotating means from the drum when a fire detecting means is actuated allowing the closure to unwind off the drum by the force of gravity, to close the opening. Re-engaging means are provided, operable from the ground, for re-engaging the drum rotating means so that the closure can be raised by the rotating means in an emergency.

DESCRIPTION OF THE PREFERRED EMBODIMENTS

Figure 1:
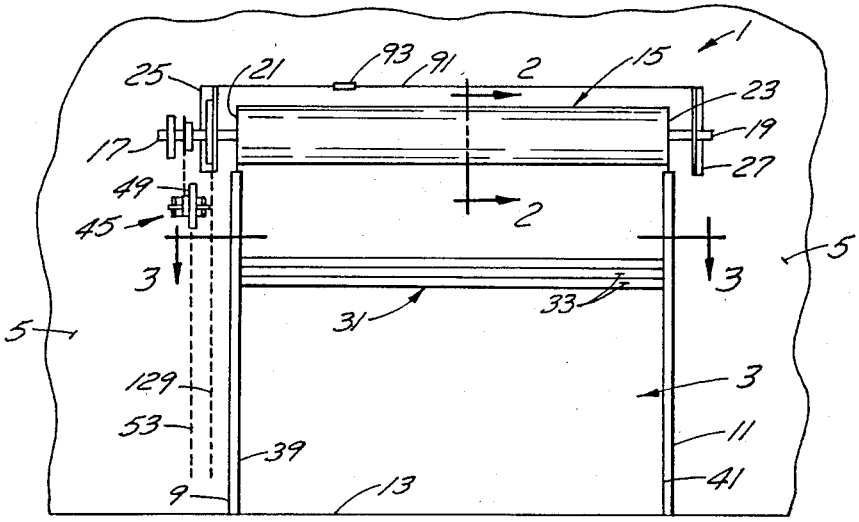
FIG. 1 is a front view of the rolling firedoor mounted in an opening.
Figure 2:
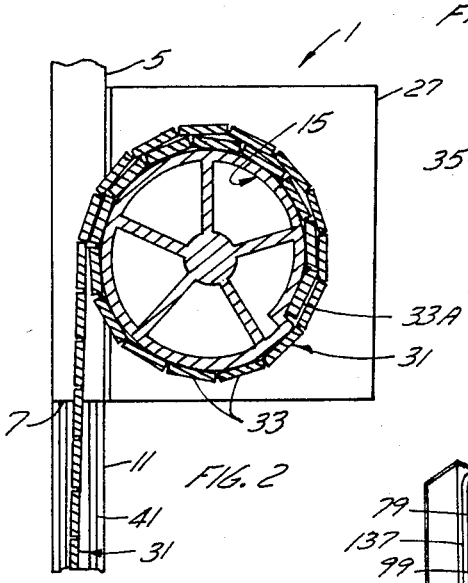
FIG. 2 is a cross-section view taken along line 2—2 in FIG. 1.
Figure 3:
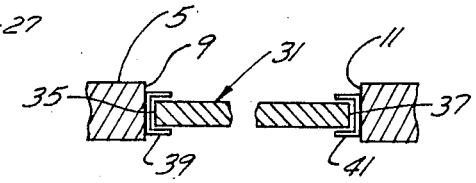
FIG. 3 is a cross-section view taken along line 3—3 in FIG. 1.

The firedoor 1 of the present invention as shown in FIGS. 1 to 3 is used to close an opening 3 in a wall 5 in a building, the opening 3 defined by a top, horizontal, edge 7, vertical side edges 9, 11 and the floor 13 of the building. The firedoor 1 has a support drum 15 that is adapted to be rotatably mounted by axles 17, 19 at its ends 21, 23 on the wall 5 above the opening 3. The drum 15 extends horizontally across the top 7 of the opening 3 and the axles 17, 19 are rotatably mounted in brackets 25, 27 fastened to the wall 5 adjacent the top edge 7 of the opening 3.

The firedoor 1 also has a closure 31 made up of a series of horizontally disposed metal panels 33 that are pivotally joined together along their horizontal edges. The first panel 33A at the top of the closure 31 is attached to the drum 15 as shown in FIG. 2. The first panel 33A extends parallel to the axis of rotation of the drum 15. Rotation of the drum 15 in one direction will wind the closure 31 up on the drum. Rotation of the drum 15 in the other direction will unwind the closure 31 off the drum closing the opening 3. The side edges 35, 37 of the closure 31 are guided in vertical channels or guides 39, 41 mounted on the wall 5 adjacent the side edges 9, 11 of the opening as shown in FIG. 3.

Figure 4:
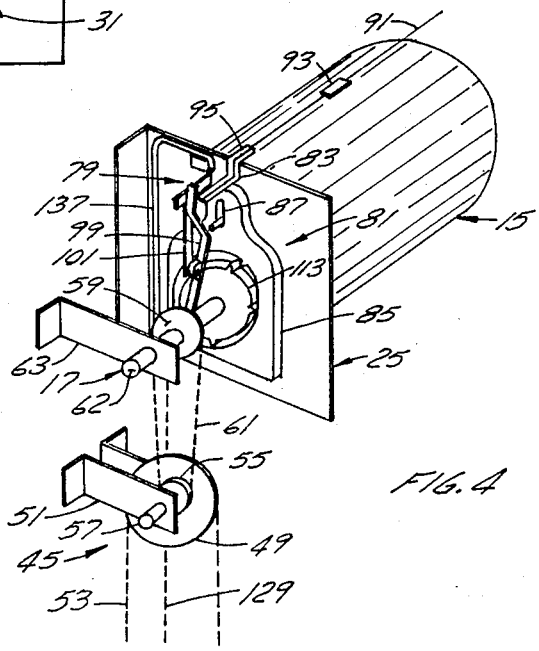
FIG. 4 is a detail perspective view of one end of the firedoor.
Figure 5:
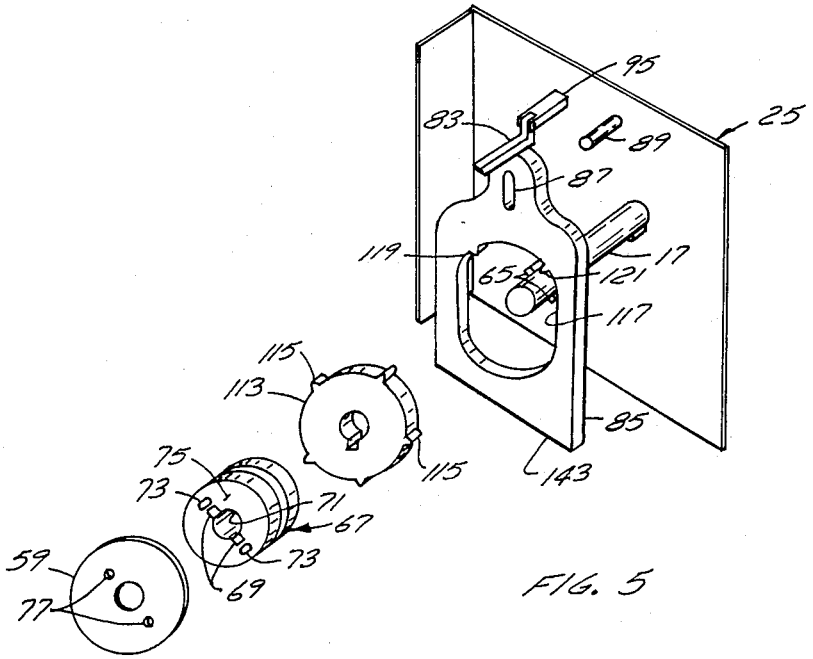
FIG. 5 is an exploded, perspective view showing details of the disengaging means and the braking means.

Means are provided for rotating the drum 15 to raise or lower the closure 31. The rotating means comprises a chain drive 45 that is operatively connected to the drum via a clutch. The chain drive 45 has a large sprocket wheel 49 mounted for rotation about a horizontal axis in a bracket 51 as shown in FIG. 4. The bracket 51 is mounted by suitable means on the wall 5, or on one of the guides 39, just beneath one end of the drum 15. A long chain loop 53 is mounted on the sprocket wheel 49 and hangs down to a point where it can be operated by a person standing on the floor. A small sprocket wheel 55 is fixedly mounted on the shaft 57 supporting the large sprocket wheel 49, and adjacent to the large wheel 49. An intermediate sprocket wheel 59 is rotatably mounted on the axle 17 of the drum 15 near the end 62 of the axle. The sprocket wheel 59 is prevented from moving axially along the axle 17 by a bracket 63, supporting the outer end of the axle 17, on one side, and a pair of diametrically opposed keys 65 on the axle 17 on the other side, as shown in FIG. 5. A clutch 67, having opposed keyways 69 in a central bore 71, is slidably mounted on the axle 17 adjacent the sprocket wheel 59 with the keys 65 located in the keyways 69. The keys 65 prevent the clutch from rotating on the axle, but allow it to slide on the axle. The clutch 67 has a pair of pins 73 on its face 75 adjacent the sprocket wheel 59. The sprocket wheel 59 has a pair of openings 77 for receiving the pins 73. When clutch 67 is positioned adjacent the sprocket wheel 59, with the pins 73 on the clutch 67 inserted in the openings 77 in the sprocket wheel 59, rotation of the sprocket wheel 59 by the chain drive 45 will rotate the drum 15. With the clutch 67 moved on the axle to remove the pins 73 from the sprocket wheel 59, the chain drive 45 cannot rotate the drum 15. Thus, with the clutch connected, a person pulling on chain loop 53 will rotate the large sprocket wheel 49 which in turn will rotate the small sprocket wheel 55. Rotation of the small sprocket wheel 55 will in turn rotate the intermediate sprocket wheel 59 via chain drive 61. Rotation of the intermediate sprocket wheel 59 will, via clutch 67 and keys 65 rotate axle 17, and thus drum 15.

Means are provided for disengaging the clutch 67 from the sprocket wheel 59 when a fire occurs so that the firedoor, if open, can automatically close. With the clutch 67 disengaged, and spring tension reduced as is well known, the unbalanced weight of the wound-up closure 31 on the drum 15 is sufficient to start the drum 15 turning to unwind the closure 31 off the drum 15, by gravity, to close the opening. As the closure unwinds off the drum 15 governor or braking means 81 are also provided for braking the drum 15 to control the lowering of the closure 31. The clutch disengaging means 79 and the braking means 81 share elements as will be described.

Figure 6:
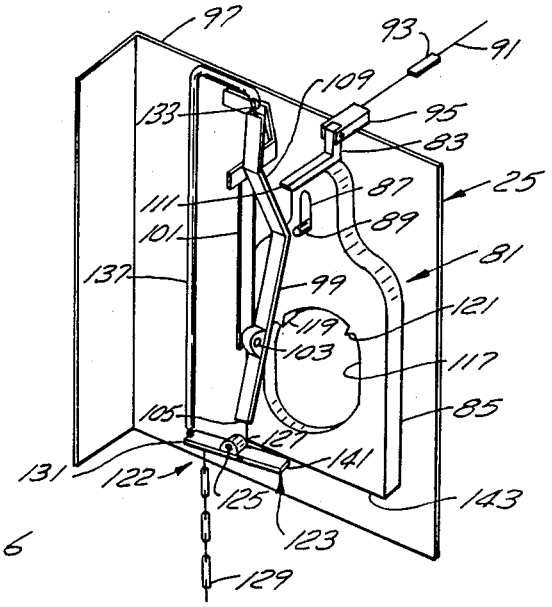
FIG. 6 is a perspective view showing details of the disengaging and re-engaging means.
Figure 7:
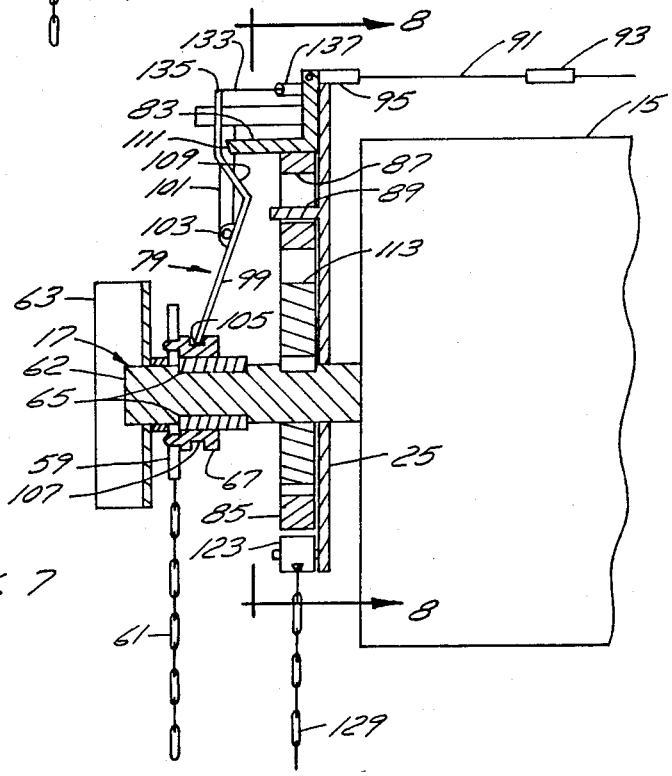
FIG. 7 is a longitudinal cross-section view taken at one end of the firedoor.

The clutch disengaging means 79, as shown in FIGS. 4, 6 and 7 has an actuating finger 83 fixedly mounted on the top of an escapement plate 85. The escapement plate 85 forms part of the braking means 81 as will be described. The escapement plate 85 has a vertically extending, slightly offset, slot 87 in its upper portion. A pivot pin 89 projects outwardly from bracket 25 and enters slot 87. The escapement plate 85 lies against the bracket 25. A wire 91, having a fusible line 93 therein, extends across the top of the drum 15. One end of the wire 91 is fixed to the top of bracket 27. The other end of the wire 91 is fixed to a pin 95 which is pivotally mounted to the top of the actuating finger 83. The pin 95 normally extends to the top edge 97 of bracket 25. The wire 91 holds the escapement plate 85, and the attached actuating finger 83, in a raised, ready, position with the pivot pin 89 located near the bottom of the slot 87. The wire 91 is also operatively connected by suitable means (not shown) to tension control means controlling the tension of the spring means associated with the drum. These spring means normally act to maintain the closure in a raised position providing enough tension to overcome gravitational force acting on the unbalanced weight of the wound-up closure on the drum.

The clutch disengaging means includes a clutch lever 99 as shown in FIGS. 6 and 7. The clutch lever 99 is pivotally mounted in a generally vertical position on a secondary bracket 101 extending outwardly from the main end bracket 25. The lever 99 is rotatably mounted on a pivot pin 103 near its center. The lower end 105 of the lever 99 enters a circular groove 107 on the sliding clutch 67. The upper portion of lever 99 is bent outwardly, then upwardly to form an upwardly, outwardly angled, camming portion 109. The angled camming portion 109 of clutch lever 99 is located just beneath the outer end 111 of the actuating finger 83 with the escapement plate 85 in a raised, ready position.

Figure 8:
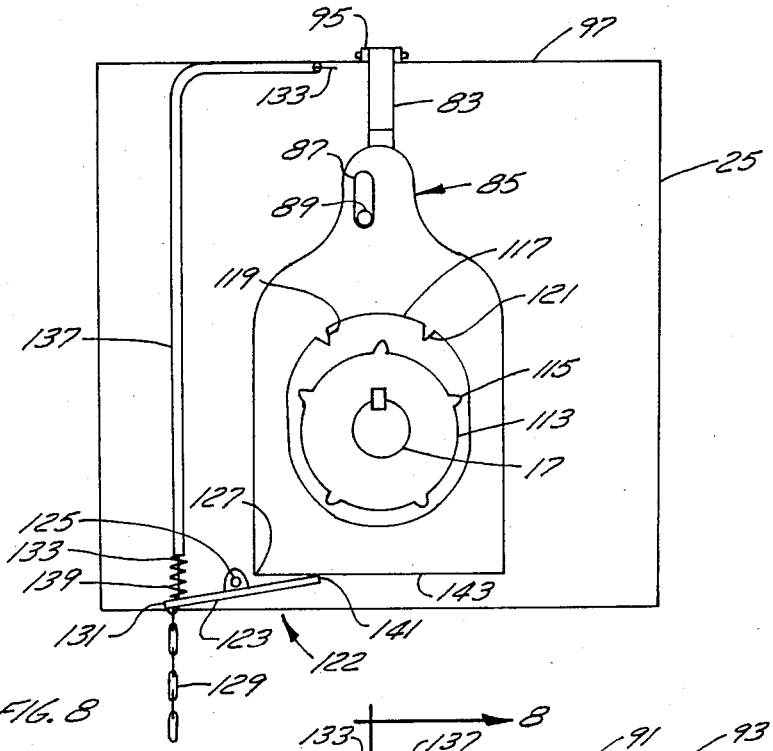
FIG. 8 is a cross-section view taken along line 8—8 of FIG. 7.

The braking means 81 are well known. As shown in FIGS. 5 and 8 they include an escapement wheel 113 fixedly mounted on the axle 17 adjacent the outer side of bracket 25. The escapement wheel 113 has a set of teeth 115 about its outer periphery. The wheel 113 is located within an opening 117 in the bottom portion of the escapement plate 85. A pair of lugs 119, 121, formed on the plate 85, project into the opening 117. The lugs 119, 121 are located at the top of the opening 117 and are spaced about one hundred and twenty degrees apart. The lugs 119, 121 are normally located above the escapement wheel 113 with the escapement plate 85 in its raised, ready position as shown in FIG. 8 and do not interfere with the normal operation of the drum 15. However, when the escapement plate 85 drops during a fire, the lugs 119, 121 will cooperate with the teeth 115 on the escapement wheel 113 to control lowering of the closure as will be described.

When a fire occurs, with the closure raised, the fusible link 93 melts, releasing the wire 91 holding the escapement plate 85 in a raised position. The escapement plate 85 now falls a distance equal to the length of the slot 87 until the pivot pin 89 hits the top of the slot 87. As the plate falls, the actuating finger 83 contacts the camming portion 109 of the clutch lever 99 and pivots the clutch lever 99 about its mounting pin 103. As the clutch lever 99 pivots, its lower end 105 slides the clutch 67 on axle 17 away from sprocket wheel 59 to disengage the drum from the chain drive 45. When the wire 91 is released, it also releases some of the tension on the drum spring means. The unbalanced weight of the closure 31 wound on the drum 15 now causes the closure to unwind off the drum moving down to close the opening and preventing the fire from spreading.

As the closure unwinds, the braking means 81 operates to control the rate of descent. The slightly offset mounting of the escapement plate 85 causes it to pivot about pin 89 as it falls bringing one of the lugs 119 into contact with the teeth 115 on the escapement wheel 113 fixed to the axle 17. As the drum 15 rotates so does the escapement wheel 113. The rotating wheel 113 now alternatively moves the escapement plate 85 left and right through the teeth 115 cooperating alternatively with the lugs 119, 121. As the plate 85 swings back and forth on the pivot pin 89 the lugs 119, 121 control the rotation of the drum 15 so that the closure 31 is lowered in a controlled manner and will not damage or injure anything that it might drop on.

In accordance with the present invention means are provided for re-engaging the chain drive 45 with the drum 15 so that the closure 31 can be raised. These re-engaging means are constructed to be operated from the floor so that the operation can be done quickly. The re-engaging means 122, as shown in FIGS. 6, 7 and 8 includes a pivoted lifting lever 123 located just beneath the lowered escapement plate 85. The lever 123 is mounted on a pivot pin 125 intermediate its ends which pin 125 projects laterally from the bracket 25. The pin 125 is located just under one bottom corner 127 of the plate 85. A chain or cable 129 is fixed to the lever 123 adjacent its outer end 131. The chain 129 hangs down to the floor.

An actuating wire 133 extends up from the lifting lever 123 to the top end 135 of the actuating lever 99. The wire 133 is similar to a Bowden cable and is guided in a tube 137 which is mounted on the bracket 25. The wire 133 is fixed to the lifting lever 123 adjacent its outer end 131. A tension spring 139 is mounted between the lever 123 and end of the guiding tube 137, and about the wire 133.

In the normal operating position of the closure, with the clutch lever 99 engaged with the clutch 67 and the clutch 67 engaged with sprocket wheel 59, the wire 133 and the untensioned spring 139 will hold the lifting lever 123 in neutral position. When the escapement plate 85 has dropped however, the actuating lever 99 is moved by the finger 83 in a manner to lift the outer end 131 of the actuating lever 123 upwardly via the wire 133 and spring 139. The inner end 141 of the lifting lever 123 lies closely adjacent the bottom edge 143 of the dropped escapement plate 85.

To re-engage the chain drive means 45, an operator on the floor 13 merely pulls down on the chain 129. This causes the lever 123 to tilt about the pivot pin 125, raising the escapement plate 85 with the inner end 141 of the lever 123. At the same time, the outer end 131 of the lever 123 drops, tensioning spring 139 and pulling the wire 133 to pivot the lever 99. As lever 99 pivots, it causes clutch 67 to re-engage the sprocket wheel 59 via its pins 73. Thus the chain drive means 45 are connected to the drum 15 by an operator on the ground. The chain drive means 45 can be operated when the chain 129 is pulled to slightly rotate the sprocket wheel 59 to help it re-engage the clutch 67. Once the clutch 67 is re-engaged, and while still pulling on the cable 129, the chain drive means 45 can be operated to raise the closure 31, if needed, in an emergency situation. It will be seen that the operation can be quickly and easily carried out from the floor of the building.

I claim:

1. A rolling firedoor having: a support drum adapted to be mounted horizontally across the top of an opening; a closure comprising a series of horizontally extending slats hingedly connected together, the closure attached at one end to the drum and adapted to be wound up on the drum when the drum is rotated in one direction; rotating means, operable from the ground, for rotating the drum in either direction to wind or unwind the closure on or off the drum; disengaging means for automatically disengaging the drum from the rotating means when a fire detecting means is actuated to allow the closure to unwind off the drum by gravitational force; braking means movable between an inoperative position, disconnected from the drum, and an operative position, connected to the drum for controlling the unwinding of the closure off the drum; means operatively connecting the disengaging means with the braking means to automatically move the braking means to the operative position simultaneously with the disengagement of the drum from the rotating means; and re-engaging means, operable from the ground, for re-engaging the drum with the rotating means and simultaneously moving the braking means to the inoperative position so the closure can be raised by the rotating means in an emergency.

2. A rolling firedoor as claimed in claim 1 wherein the braking means has an escapement member movable between a raised inoperative position, and a lowered operative position, the disengaging means holding the escapement member in its raised inoperative position until the fire detecting means is actuated, the escapement member dropping to its operative position when the fire detecting means is actuated to cooperate with an escapement wheel on the drum to control the unwinding of the closure off the drum.

3. A rolling firedoor as claimed in claim 2 wherein the rotating means includes a clutch to connect or disconnect the rotating means to the drum, the disengaging means having a pivoted clutch lever connected to the clutch and means on the escapement member contacting the clutch lever as the escapement member drops to pivot the clutch lever to move the clutch to disconnect the rotating means from the drum.

4. A rolling firedoor as claimed in claim 3 wherein the re-engaging means has a pivoted lifting lever and means operable from the ground to pivot the lifting lever, the lifting lever located so as to have one end raise the escapement member to its inoperative position from its dropped operative position when pivoted, and thus disengage the braking means.

5. A rolling firedoor as claimed in claim 3 wherein the re-engaging means is connected to the clutch lever to pivot the clutch lever to move the clutch to reconnect the rotating means to the drum.

6. A rolling firedoor as claimed in claim 4 including means connected between the other end of the lifting lever and the clutch lever to pivot the clutch lever to move the clutch to connect the rotating means to the drum as the escapement member is being raised.

7. A rolling firedoor having:

a support drum adapted to be mounted horizontally across the top of an opening;

a closure comprising a series of horizontally extending slats hingedly connected together, the closure attached at one end to the drum and adapted to be wound up on the drum when the drum is rotated in one direction;

rotating means, operable from the ground, for rotating the drum in either direction to wind or unwind the closure on or off the drum, the rotating means comprising a chain drive operable from the ground and a clutch slidably mounted on an axle of the drum, the clutch connected to the chain drive operable, in a first position on the axle, to rotate the drum when the chain drive is operated, and in a second position on the axle, to not rotate the drum when the chain drive is operated;

disengaging means for automatically disengaging the drum from the rotating means when a fire detecting means is actuated to allow the closure to unwind off the drum by gravitational force;

the disengaging means comprising an actuating member retained in a raised position by a wire having a fusible link therein, and a clutch lever located beneath the actuating member when said member is in a raised position, and operably connected to the clutch, whereby when the fusible link breaks, the actuating member drops to a lowered position and in so doing moves the clutch lever to move the clutch from its first position to its second position;

braking means for controlling the unwinding of the closure off the drum;

the braking means employing the actuating member; means for pivotally mounting the actuating member for swinging movement in its lowered position; an escapement wheel fixed on the axle of the drum; and escapement means on the actuating member which cooperate with the escapement wheel when the actuating member is in its lowered position to control the speed of rotation of the drum as the closure is unwinding;

and re-engaging means, operable from the ground, for re-engaging the rotating means with the drum, and disconnecting the braking means, so the closure can be raised by the rotating means in an emergency.

8. A rolling firedoor as claimed in claim 7 wherein the re-engaging means has a wire connected at one end to the clutch lever and at its other end to a chain hanging down to the ground whereby a pull on the chain will move the clutch lever to move the clutch from its second position to its first position.

9. A rolling firedoor as claimed in claim 8 wherein the other end of the wire is connected to one end of a pivoted lifting lever, the chain also connected to the one end of the lifting lever, the other end of the lifting lever located under the actuating member, whereby when the chain is pulled down to move the clutch lever via the wire, it will pivot the lifting lever to simultaneously raise the actuating member by its other end from its lowered position to its raised position to disengage the braking means.

* * * * *